US007944353B2

(12) United States Patent
Grim, III et al.

(10) Patent No.: US 7,944,353 B2
(45) Date of Patent: May 17, 2011

(54) SYSTEM AND METHOD FOR DETECTING AND BROADCASTING A CRITICAL EVENT

(75) Inventors: Clifton E. Grim, III, Seabrook, TX (US); Rex Edward Marzke, Houston, TX (US); Gary A. Ward, Seabrook, TX (US); John David Wilson, Houston, TX (US)

(73) Assignee: International Business Machines Corporation, Armonk, NY (US)

( * ) Notice: Subject to any disclaimer, the term of this patent is extended or adjusted under 35 U.S.C. 154(b) by 363 days.

(21) Appl. No.: 12/130,471

(22) Filed: May 30, 2008

(65) Prior Publication Data

US 2009/0295572 A1 Dec. 3, 2009

(51) Int. Cl.
*G08B 21/00* (2006.01)
*G08B 29/00* (2006.01)

(52) U.S. Cl. ..... 340/540; 340/506; 340/511; 340/531; 340/539.22; 340/539.26

(58) Field of Classification Search ..... 340/540
See application file for complete search history.

(56) References Cited

U.S. PATENT DOCUMENTS

| | | | | |
|---|---|---|---|---|
| 5,455,868 | A | 10/1995 | Sergent et al. | |
| 5,692,446 | A | 12/1997 | Becker et al. | |
| 5,950,150 | A * | 9/1999 | Lloyd et al. | 702/183 |
| 6,542,075 | B2 * | 4/2003 | Barker et al. | 340/506 |
| 2002/0022894 | A1 * | 2/2002 | Eryurek et al. | 700/80 |
| 2002/0050926 | A1 * | 5/2002 | Lewis et al. | 340/506 |
| 2002/0121244 | A1 | 9/2002 | Berg et al. | |

FOREIGN PATENT DOCUMENTS

WO 9419571 A1 9/1994

* cited by examiner

*Primary Examiner* — Donnie L Crosland
(74) *Attorney, Agent, or Firm* — Yee & Associates, P.C.; John R. Pivnichny

(57) ABSTRACT

A system and method for detecting and reporting a critical event. Events may be continually detected by sensors and processed as digitized data. The digitized data may be compared to signature data stored in glossaries. If a match exists between the digitized data and the signature data, the event may be reported. An analysis of the event may be performed and based on a result of the analysis, an alarm notice may be sent.

20 Claims, 7 Drawing Sheets

SYSTEM AND METHOD FOR DETECTING AND BROADCASTING A CRITICAL EVENT

CROSS-REFERENCE TO RELATED APPLICATIONS

This application is related to U.S. application Ser. No. 11/968,772 filed Jan. 3, 2008, and entitled "Method and Apparatus For Digital Life Recording And Playback", incorporated by reference herein for all purposes.

BACKGROUND

1. Field of the Invention

The present invention relates generally to personal security systems and, more specifically, to a system and method for detecting and signaling the existence of a critical event.

2. Description of the Related Art

When a critical event occurs, there may frequently be a delay in summoning assistance or dispatching emergency personnel or other equipment to the area of the emergency. Delays may be attributed to various problems. For example, a delay may be caused by an inability to reach emergency personnel by a standard communication method, such as a telephone. A delay may also be caused by uncertainty regarding whether an event should be treated as an emergency. Additionally, a delay may be caused by confusion or other concerns regarding the appropriate personnel or equipment to dispatch for a particular emergency. Delays in response may compromise or jeopardize the security, safety or health of individual persons or the public-at-large. A related application Ser. No. 11/968,772, filed Jan. 3, 2008, entitled "Method and Apparatus For Digital Life Recording And Playback", discloses a networked system that continually senses and captures information associated with all aspects of a person's daily activities and life. The captured information may include the occurrence of a critical event or other emergency that requires prompt reporting and quick action. Reducing the response time when an emergency or other critical event occurs would improve security, provide a valuable public service and increase individual and public safety.

BRIEF SUMMARY

This disclosure describes a personal safety alert system that broadcasts the occurrence of a critical event or other emergency situation so that public safety personnel or other assistance may be notified quickly.

According to one disclosed class of innovative embodiments, there is provided a computer-implemented method of reporting a critical event comprises acquiring input data that may comprise a stream of digitized signature data. The input data is continuously analyzed to determine an event context. A priority of the determined event context is assessed and responsive to the priority assessment, a reporting response is generated.

According to another disclosed class of innovative embodiments, there is disclosed a system comprising a plurality of integrated subsystems configurable for processing sensory data. The system comprises an analysis subsystem that determines an event context based on a glossary comprising signature data and a reporting subsystem communicatively coupled to the analysis subsystem that receives the events determined by the analysis subsystem.

According to another disclosed class of innovative embodiments, there is disclosed a system for broadcasting a critical alert. The system comprises an external interface, a receiving mechanism that logs a receipt of an alert, a prioritizing mechanism that grades the urgency of the received alert based on a configuration setting and a distributing mechanism that broadcasts an alarm responsive to grading the urgency of the received alert.

The embodiments of the disclosure provide an advantage of minimizing the response time during an emergency by automatically sending alerts or alarms to designated emergency personnel or to a public safety sub-system that disseminates the alert or alarm.

The embodiments of the disclosure also provide an advantage of automatically determining whether or not an event should be categorized as requiring an emergency response and a broadcast alert.

The embodiments of the disclosure also provide an advantage of providing a personal protection system that provides an advance warning of impending potentially negative events.

These and other advantages will be more clearly understood from the following detailed description taken in conjunction with the accompanying drawings and claims.

BRIEF DESCRIPTION OF THE SEVERAL VIEWS OF THE DRAWINGS

For a more complete understanding of the present disclosure and the advantages thereof, reference is now made to the following brief description, taken in connection with the accompanying drawings and detailed description, wherein similar or identical reference numerals represent similar or identical parts.

DETAILED DESCRIPTION

Figure 1:
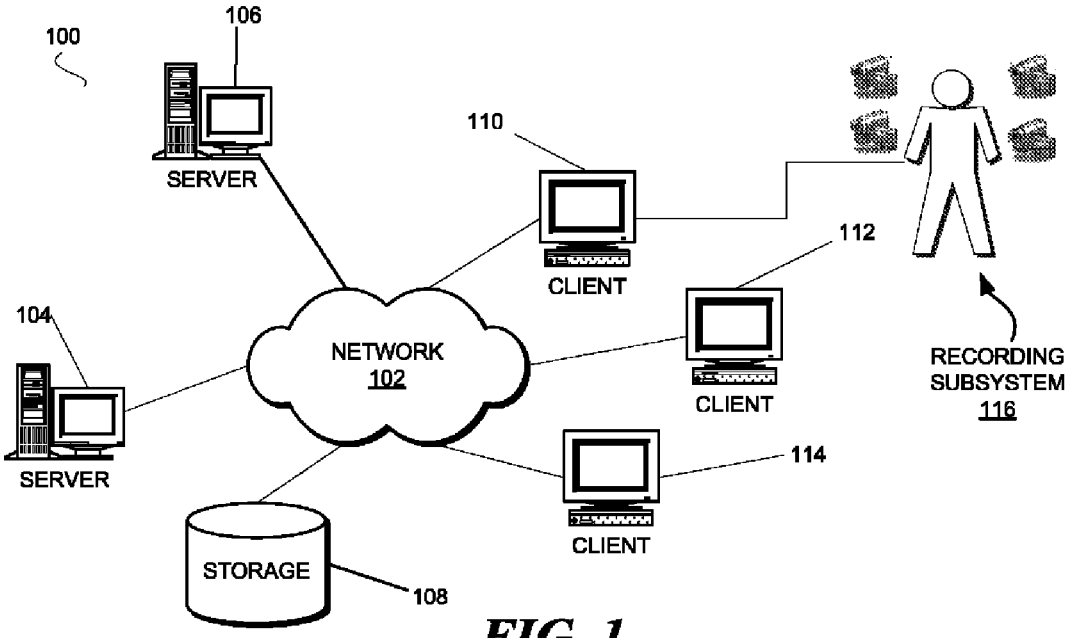
FIG. 1 is a representation of a network of data processing systems in which illustrative embodiments may be implemented.

The present disclosure is described below with reference to flowchart illustrations and/or block diagrams of methods, systems and computer program products according to embodiments of the invention. It will be understood that each block of the flowchart illustrations and/or block diagrams, and combinations of blocks in the flowchart illustrations and/or block diagrams, can be implemented by computer program instructions.

These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks. These computer program instructions may also be stored in a computer-readable medium that can direct a computer or other programmable data processing apparatus to function in a particular manner, such that the instructions stored in the computer-readable medium produce an article of manufacture including instruction means which implement the function/act specified in the flowchart and/or block diagram block or blocks.

The computer program instructions may also be loaded onto a computer or other programmable data processing apparatus to cause a series of operational steps to be performed on the computer or other programmable apparatus to produce a computer implemented process such that the instructions which execute on the computer or other programmable apparatus provide processes for implementing the functions/acts specified in the flowchart and/or block diagram block or blocks.

As will be appreciated by one skilled in the art, the present invention may be embodied as a system, method or computer program product. Accordingly, the present invention may take the form of an entirely hardware embodiment, an entirely software embodiment (including firmware, resident software, micro-code, etc.) or an embodiment combining software and hardware aspects that may all generally be referred to herein as a "circuit," "module" or "system." Furthermore, the computer program product embodied in any tangible medium of expression having computer usable program code embodied in the medium.

In embodiments of this disclosure, a personal sensor alert (SensAlert) system is integrated into a communication infrastructure and network, such as the Digital Life Recording network detailed in U.S. application Ser. No. 11/968,772, filed Jan. 3, 2008, entitled "Method and Apparatus For Digital Life Recording And Playback", incorporated by reference herein for all purposes. SensAlert broadcasts an alert or alarm notification of a critical or dangerous event occurrence to a public safety network or other pre-specified emergency assistance. The system receives input data from a multiplicity of sources. The data may be biometric, audio, video, location or other type of external digital data. As the data is analyzed, the criticality of the information received is evaluated. SensAlert determines the type of response required based the analysis and evaluation and enables an alert or alarm to be reported or broadcast to a public safety network or other network or entity for an immediate response.

Figure 2:
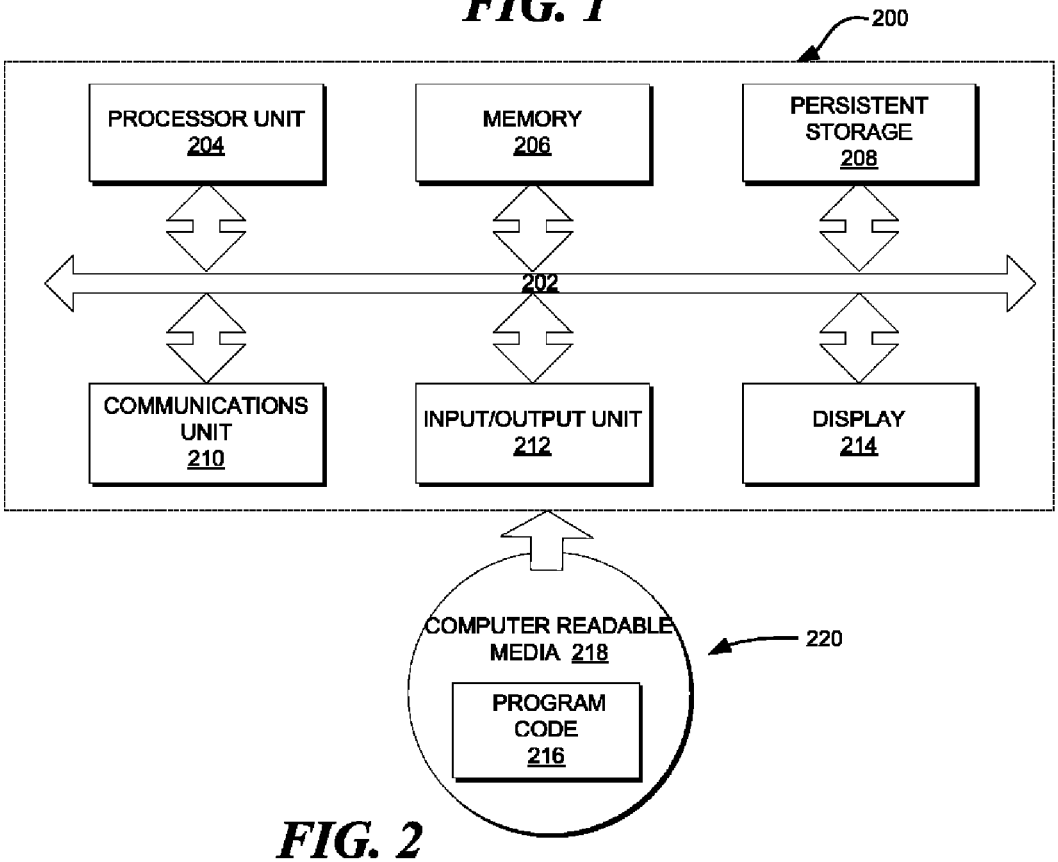
FIG. 2 is a block diagram of a data processing system in which illustrative embodiments may be implemented.

With reference now to the figures, and in particular with reference to FIGS. 1-2, exemplary diagrams of data processing environments are provided in which illustrative embodiments may be implemented. It should be appreciated that FIGS. 1-2 are only exemplary and are not intended to assert or imply any limitation with regard to the environments in which different embodiments may be implemented. Many modifications to the depicted environments may be made.

FIG. 1 depicts a pictorial representation of a network of data processing systems in which illustrative embodiments may be implemented. Network data processing system 100 is a network of computers in which embodiments may be implemented. Network data processing system 100 contains network 102, which is the medium used to provide communications links between various devices and computers connected together within network data processing system 100. Network 102 may include connections, such as wire, wireless communication links, or fiber optic cables.

In the depicted example, server 104 and server 106 connect to network 102 along with storage unit 108. In addition, clients 110, 112, and 114 connect to network 102. These clients 110, 112, and 114 may be, for example, personal computers or network computers. In the depicted example, server 104 provides data, such as boot files, operating system images, and applications to clients 110, 112, and 114. Clients 110, 112, and 114 are clients to server 104 in this example. The illustrative embodiments may be implemented in a data processing system, such as clients 110, 112, and 114. Clients 110, 112, and 114 may use an Internet browser to communicate with server 104. Network data processing system 100 may include additional servers, clients, and other devices not shown.

The illustrative embodiments may be used as a digital life recorder for capturing still images, video, audio, biometric information and other types of data associated with the daily activities of a person. The activities may be recorded on a continuous basis or may be periodically captured. For example, FIG. 1 depicts a recording subsystem 116. Recording subsystem 116 receives data captured from a plurality of data capturing devices. The data capturing devices may include, but are not limited to, video cameras. The captured data is processed by a mobile device associated with the person and is stored as raw data within a cache of the mobile device. Upon interfacing with a repository mass store, such as client 110, the stored data within the cache of the mobile device is uploaded to the repository mass store. Client 110 manages the data within the repository mass store and presents the data in response to a user request. Additional details of recording subsystem 116 and the repository mass store will be described below.

Network 102 may be, without limitation, a local area network (LAN), wide area network (WAN), Internet, Ethernet, or Intranet. In this example, network 102 is the Internet, representing a worldwide collection of networks and gateways that use the Transmission Control Protocol/Internet Protocol (TCP/IP) suite of protocols to communicate with one another. At the heart of the Internet is a backbone of high-speed data communication lines between major nodes or host computers, consisting of thousands of commercial, governmental, educational and other computer systems that route data and messages. Of course, network data processing system 100 also may be implemented as a number of different types of networks, such as for example, an intranet, a local area network (LAN), or a wide area network (WAN). FIG. 1 is intended as an example, and not as an architectural limitation for different embodiments.

Turning now to FIG. 2, a diagram of a data processing system is depicted in accordance with an illustrative embodiment of the present invention. In this illustrative example, data processing system 200 includes communications fabric 202, which provides communications between processor unit 204, memory 206, persistent storage 208, communications unit 210, input/output (I/O) unit 212, and display 214.

Processor unit 204 serves to execute instructions for software that may be loaded into memory 206. Processor unit 204 may be a set of one or more processors or may be a multiprocessor core, depending on the particular implementation. Further, processor unit 204 may be implemented using one or more heterogeneous processor systems in which a main processor is present with secondary processors on a single chip. As another illustrative example, processor unit 204 may be a symmetric multi-processor system containing multiple processors of the same type.

Memory 206, in these examples, may be, for example, a random access memory or any other suitable volatile or non-volatile storage device. Persistent storage 208 may take various forms depending on the particular implementation. For example, persistent storage 208 may contain one or more components or devices. For example, persistent storage 208 may be a hard drive, a flash memory, a rewritable optical disk, a rewritable magnetic tape, or some combination of the above. The media used by persistent storage 208 also may be removable. For example, a removable hard drive may be used for persistent storage 208.

Communications unit 210, in these examples, provides for communications with other data processing systems or devices. In these examples, communications unit 210 is a network interface card. Communications unit 210 may provide communications through the use of either or both physical and wireless communications links.

Input/output unit 212 allows for input and output of data with other devices that may be connected to data processing system 200. For example, input/output unit 212 may provide a connection for user input through a keyboard and mouse. Further, input/output unit 212 may send output to a printer. Display 214 provides a mechanism to display information to a user.

Instructions for the operating system and applications or programs are located on persistent storage 208. These instructions may be loaded into memory 206 for execution by processor unit 204. The processes of the different embodiments may be performed by processor unit 204 using computer implemented instructions, which may be located in a memory, such as memory 206. These instructions are referred to as program code, computer usable program code, or computer readable program code that may be read and executed by a processor in processor unit 204. The program code in the different embodiments may be embodied on different physical or tangible computer readable media, such as memory 206 or persistent storage 208.

Program code 216 is located in a functional form on computer readable media 218 that is selectively removable and may be loaded onto or transferred to data processing system 200 for execution by processor unit 204. Program code 216 and computer readable media 218 form computer program product 220 in these examples. In one example, computer readable media 218 may be in a tangible form, such as, for example, an optical or magnetic disc that is inserted or placed into a drive or other device that is part of persistent storage 208 for transfer onto a storage device, such as a hard drive that is part of persistent storage 208. In a tangible form, computer readable media 218 also may take the form of a persistent storage, such as a hard drive, a thumb drive, or a flash memory that is connected to data processing system 200. The tangible form of computer readable media 218 is also referred to as computer recordable storage media. In some instances, computer readable media 218 may not be removable.

Alternatively, program code 216 may be transferred to data processing system 200 from computer readable media 218 through a communications link to communications unit 210 and/or through a connection to input/output unit 212. The communications link and/or the connection may be physical or wireless in the illustrative examples. The computer readable media also may take the form of non-tangible media, such as communications links or wireless transmissions containing the program code.

The different components illustrated for data processing system 200 are not meant to provide architectural limitations to the manner in which different embodiments may be implemented. The different illustrative embodiments may be implemented in a data processing system including components in addition to or in place of those illustrated for data processing system 200. Other components shown in FIG. 2 can be varied from the illustrative examples shown.

As one example, a storage device in data processing system 200 is any hardware apparatus that may store data. Memory 206, persistent storage 208 and computer readable media 218 are examples of storage devices in a tangible form.

In another example, a bus system may be used to implement communications fabric 202 and may be comprised of one or more buses, such as a system bus or an input/output bus. Of course, the bus system may be implemented using any suitable type of architecture that provides for a transfer of data between different components or devices attached to the bus system. Additionally, a communications unit may include one or more devices used to transmit and receive data, such as a modem or a network adapter. Further, a memory may be, for example, memory 206 or a cache such as found in an interface and memory controller hub that may be present in communications fabric 202.

The illustrative embodiments described herein provide a computer implemented method, system and computer program product for detecting and broadcasting a critical event. A plurality of data capturing devices dynamically captures data associated with the daily activities of a person. The data may be processed using a mobile device associated with the person. As depicted in FIG. 1, clients 110, 112, and 114 may represent a mobile device. The data may be stored into a cache of the mobile device. The data stored in the cache of the mobile device may be uploaded into a repository mass store in response to interfacing the mobile device with the repository mass store. Interfacing may occur over a network, such as network 102 as shown in FIG. 1. Network 102 may comprise of a wired or wireless communication link. The repository mass store may be associated with a data processing system such as data processing system 200. A selected data segment stored in the repository mass store is presented in response to receiving a request for the selected data segment.

Figure 3:
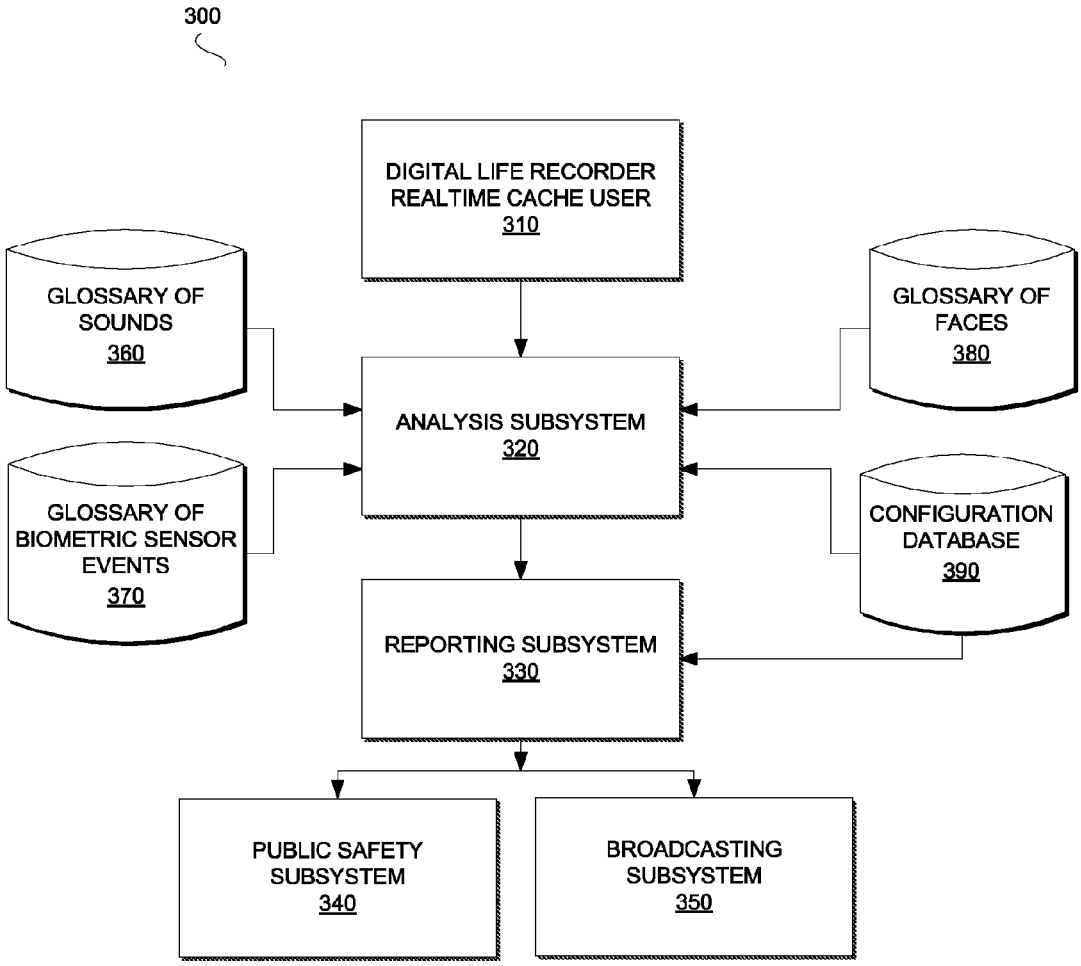
FIG. 3 is a diagram detailing the data processing according to one embodiment of the disclosure.

In FIG. 3, diagram 300 discloses one embodiment of the overall operational processing of the SensAlert system and method. Digitized data or other types of sensory data information may be stored in a digital life recording system cache 310 and provided as an input data stream to analysis system 320. Further details regarding the digital life recording (DLR) system cache and all other aspects of the DLR system may be referenced in the related application Ser. No. 11/968,772 filed Jan. 3, 2008, and entitled "Method and Apparatus For Digital Life Recording And Playback", which is incorporated by reference herein. The sensory data information may include, but is not limited to, audio data, video data, biometric information, and G-force data. It must be understood that the analysis system 320 may obtain input data from other external sources including, but not limited to, through USB ports, or optical or wireless means.

Analysis subsystem 320 may compare the input data received to other information stored in a glossary. The glossary may be similar to a database or other file repository and may organize signature data, that is, data specific to the output of a certain type of sensor or class of sensors. For example, one glossary may store digital signature data related to sound. The sound signatures may be simulated or actual and may include sounds such as gunshots, screams and glass breaking. Another glossary may store digital signature data related to faces, such as faces of missing persons, criminals, and friends. An additional glossary may include biometric signature data. The biometric signatures may include data that indicate nervousness, such as sweatiness, elevated blood pressure, and increased heart rate. There may also be glossaries that include G-force signature data, such as acceleration or deceleration or other motion or gravitational related information. Glossaries may also contain user created signatures or commands. As one of ordinary skill would recognize, other types of glossaries are possible and the glossaries provided here are not intended to be an exclusive listing.

As the input data is streamed to the analysis subsystem 320, the analysis subsystem 320 may reference a glossary of sounds 360, a glossary of biometric sensor events 370, a glossary of faces 380, and any other glossaries that may be present, to compare the incoming digital signature data with the signature data in the referenced glossaries. For example, in one embodiment, the incoming digital signature data may be compared to a sound signature in the glossary of sounds 360 and the incoming digital signature data may match a scream signature. In the same or another embodiment, the comparison may result in a gunshot signature match. In the same or yet another embodiment, a comparison with the glossary of faces 380 may result in a missing child signature match. The signature matches may be categorized as an event that the analysis subsystem 320 reports to the reporting subsystem 330. The configuration database 390 may include settings that establish sensitivity and context that affect the accuracy of the comparison process. For example, the sensitivity and context of a configuration setting for sound may affect whether or not an incoming sound of a firecracker gets matched with a shotgun signature or pistol signature. The settings of the configuration database 390 may be user-configured. For example, the configuration database 390 may include options that may raise or lower a level or awareness, or a threshold, of a subsystem. The analysis subsystem 320 determines the context or origination of an event, for example, a gunshot sound, or the sound of glass breaking, or a missing persons face or a face of a criminal, and reports the event context to the reporting subsystem 330.

The reporting subsystem 330 receives the events reported by the analysis subsystem 320 and may broadcast an alert based on the event received. The reporting subsystem 330 may filter events based on configuration settings in the configuration database 390. The configuration settings may also establish reporting criteria for various types of received events. One configuration criteria may define an event as a medical emergency. Other configuration criteria may include defining an event as a public safety emergency or problem. The configuration criteria define the criticality or importance of an event and determine whether an alert is necessary or required. For example, a glass breaking event may be received by the reporting subsystem but instead of broadcasting an alert, the glass breaking event is filtered out and no alert is reported.

The configuration settings in the configurations database 390 may influence whether or not a categorized and reported event may be broadcast and the format of the broadcast. The broadcast alert may be formatted as a text message, an automated telephonic message, an audible alarm, or may include any other type of notification signal known to one of skill in the art. The configuration setting may also include an option that supports a time delay on an alert notification that would enable a subsequent cancellation of an alarm. The configuration setting may also include the enabling or disabling of the reporting subsystem for pre-determined time periods. For example, a configuration setting may disable the reporting of any gunshot event alerts for a two hour period of time while a movie or television show is being viewed. Another option supported by configuration database 390 may be a remote programming of options.

In one embodiment, the reporting subsystem 330 may determine that a reported event is critical and require an alert to be broadcast. The reporting subsystem 330 may be configured to interface to a broadcasting subsystem 350, a public safety subsystem 340, or some other subsystem to broadcast an alert.

The broadcasting subsystem 350 receives an alert and may broadcast the alert to a user-defined list of family and/or friends. The broadcasting subsystem 350 may also broadcast to alarm companies or any other user-defined entity specified in the configurations database 390.

The reporting subsystem 330 may also broadcast an alert through a public safety subsystem 340. The public safety subsystem 340 may be configured to receive alerts from the reporting subsystem 330. It may also be configured to receive alerts from disparate or alternate reporting subsystems. The received alerts may be analyzed and distributed through an infrastructure to the appropriate personnel.

In one exemplary embodiment, a personal alert or alarm may be broadcast. For example, one event context may be the reporting of a criminal face or other illicit activity in close proximity. SensAlert may be enabled to broadcast a personal alert or alarm specific to a user to warn the user of the event. The alert or alarm may be configured to be audible, such as a ringing or buzzing sound, or silent, such as a vibration or low buzz or drone.

Figure 4:
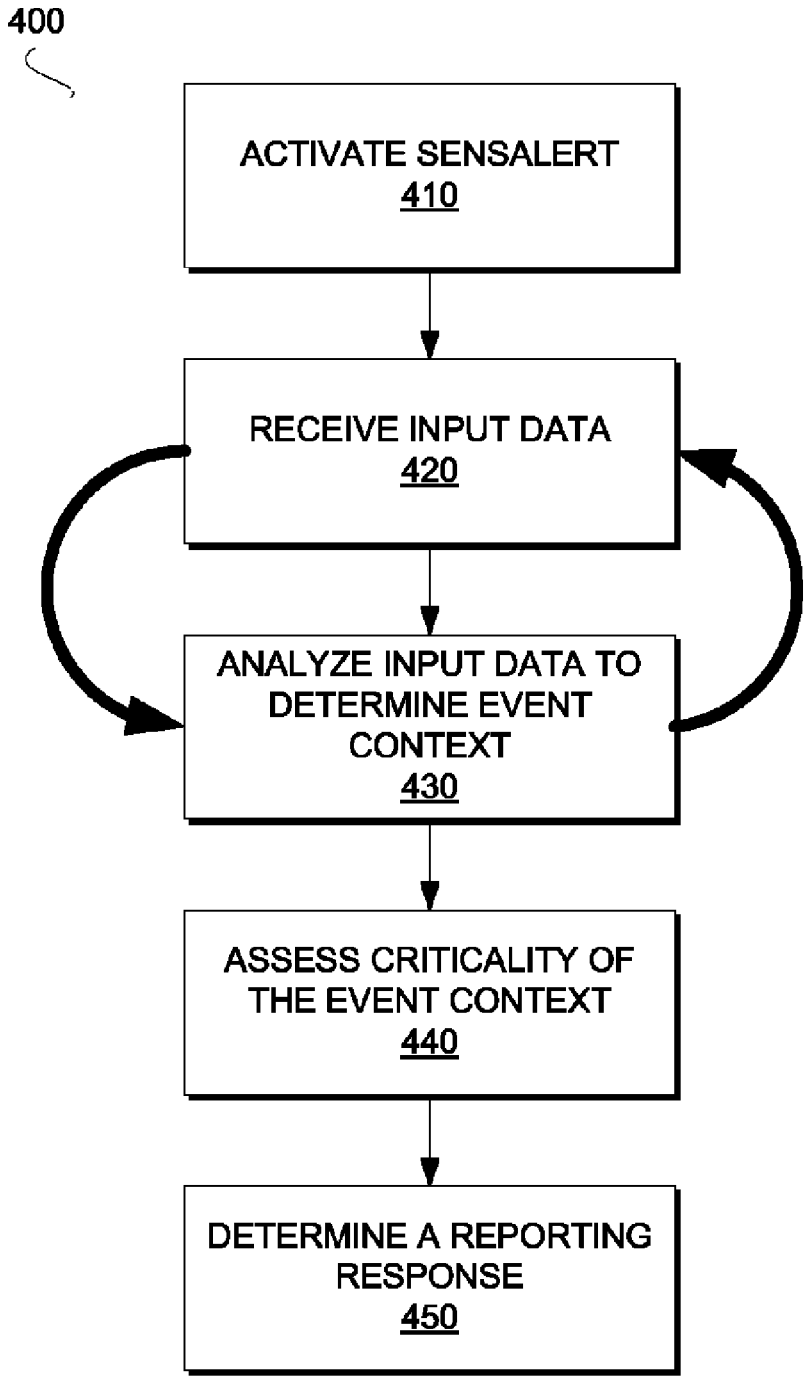
FIG. 4 is a top-level flowchart of the general process according to one embodiment of the current disclosure.

FIG. 4 presents a top-level flowchart 400 of one embodiment of the disclosure. Flowchart 400 starts with the activation of the SensAlert system at a block 410. In one embodiment, the SensAlert system may always be activated and ready to receive incoming input data through a DLR system infrastructure and other digitized sensory data infrastructures. SensAlert may receive input data at a block 420 in the form of a digitized data stream. It must be recognized that other compatible data formats may be used. At a block 430, the event context of the data may be determined based on comparing the input data stream to one or more glossaries. The criticality or priority of the event context may be assessed at a block 440, and based on the assessment, a reporting response may be determined at a block 450.

Figure 5:
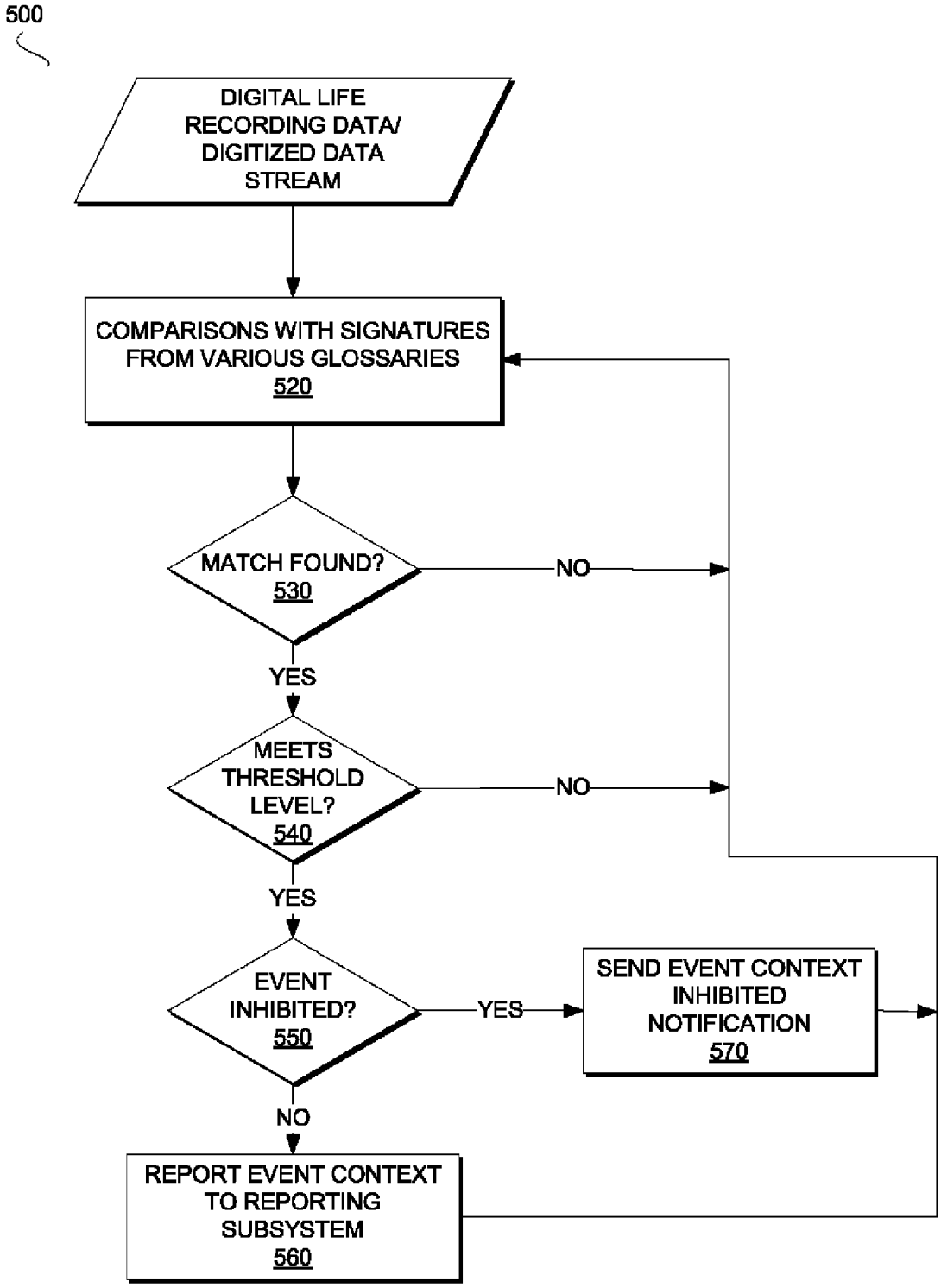
FIG. 5 is a flowchart of the analysis subsystem according to one embodiment of the current disclosure.

FIG. 5 illustrates a flowchart 500 of one embodiment of the analysis subsystem processing. Digital Life recording (DLR) data or some other form of a digitized data stream is an input 510 to the analysis subsystem at a block 520. The analysis subsystem continually inputs and processes the data it receives. The DLR data may include, but is not limited, to sound, video, faces, biometric data and other such types of data streams that may be recognized by one skilled in the art. At block 520, the input data may be compared with the signatures of various glossaries including a sound glossary, a face glossary and a biometric event glossary. At a block 530, it may be determined whether a match exists between the input digitized data and the glossary signatures. If a match exists, then the event context may be reported. The event context may specify whether the event is a sound, a face, biometric data, or some other such event. At a block 540, the analysis subsystem may use the configuration database to determine whether the event context should be reported. The configuration database may comprise a threshold setting indicator that functions to filter out events that should not be reported. The threshold setting may be configured by a user. The sensitivity and context may be part of the threshold setting. At a block 550, it is determined whether an event should be reported based on a configuration setting, i.e. whether an event is inhibited. At a block 560 an event context may be reported to a reporting subsystem.

Figure 6:
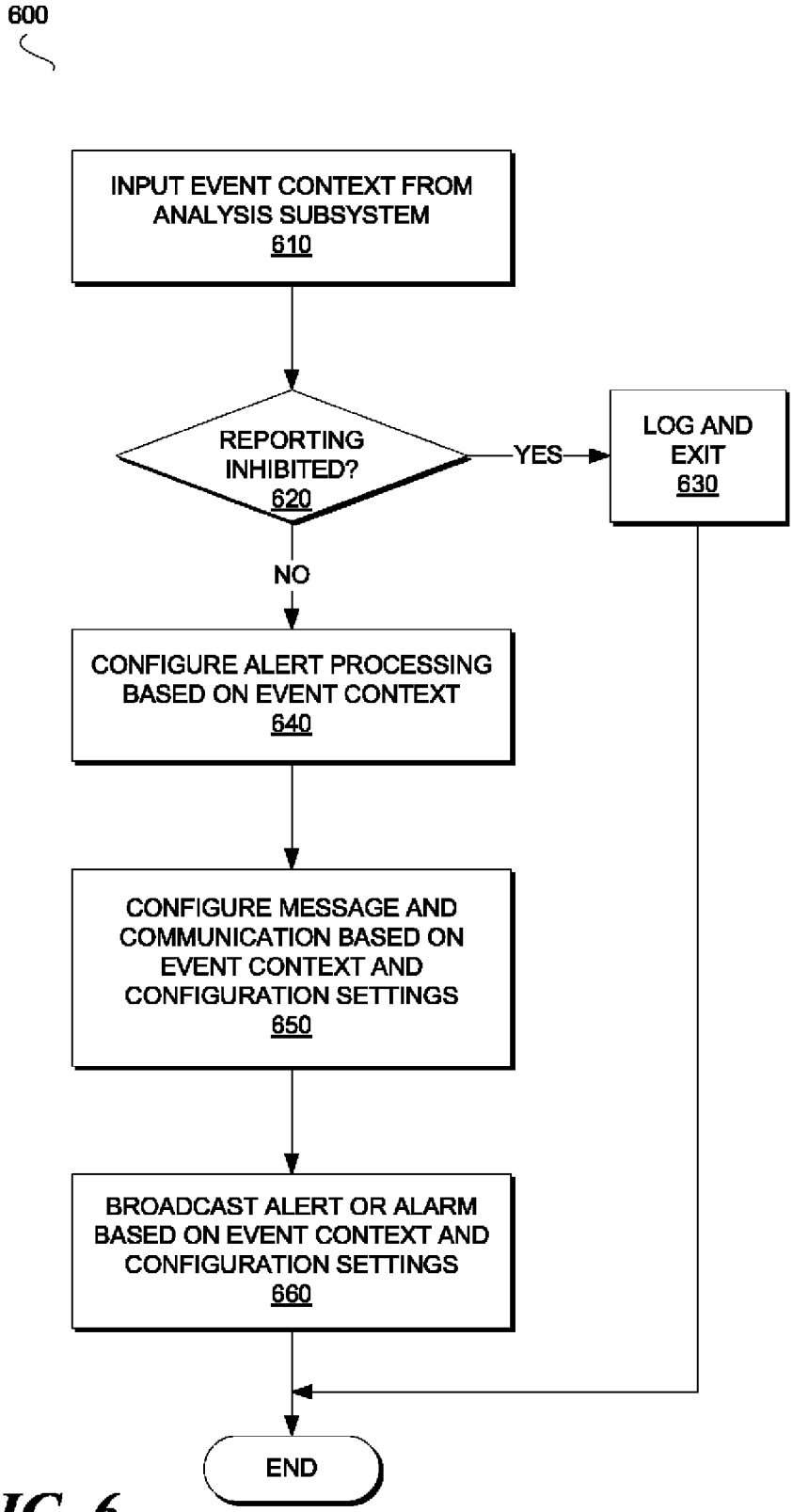
FIG. 6 is a flowchart of a general reporting subsystem according to one embodiment of the current disclosure.

Turning now to FIG. 6, flowchart 600 illustrates one embodiment of the process of the reporting subsystem. The reporting subsystem may interface to the analysis subsystem and accepts event contexts from the subsystem. The reporting subsystem may inhibit the formation and reporting of any alerts or alarms through a setting in the configuration database. At a block 620, it may be determined whether or not the reporting of the alarms or alerts are been inhibited. If a configuration setting inhibits the reporting, the process ends at a block 630. The processing of the received alerts or alarms depends on the type of event context that may be received by the reporting subsystem. If there is no configuration setting inhibiting reporting, alert processing based on the event context or type of event may commence at a block 640. At a block 650, an alert message and broadcast communication method may be configured based on the event context and configuration settings. For example, an alert message may inform about event context occurred and based on the event context, a telephonic communication method would be selected. At a block 660, the reporting subsystem may broadcast an alert or alarm based on the event context and configuration settings. For example, an alert or alarm may be scheduled to be broadcast to a particular organization, such as a missing persons bureau or a traffic control agency.

Figure 7:
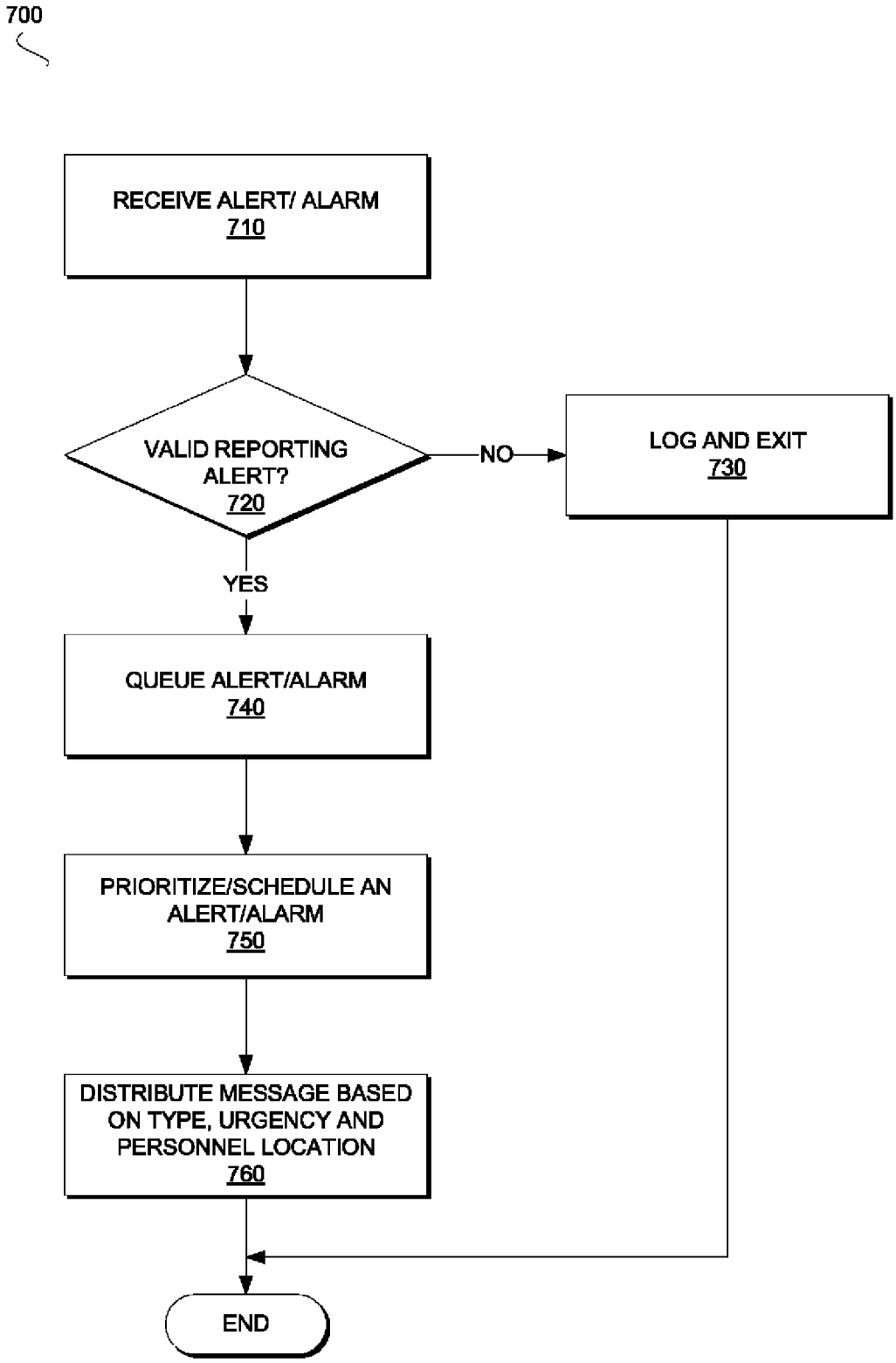
FIG. 7 is a diagram of the public safety subsystem according to one embodiment of the current disclosure.

In FIG. 7, flowchart 700 details the processing of the public safety subsystem according to one embodiment. The public safety subsystem may receive an alert or alarm at a block 710 from a reporting subsystem. At a block 720, the alert or alarm may be filtered to determine whether the alert or alarm may be valid. An alert or alarm may not be valid because a false alarm has been triggered. It is also possible that an alert or alarm may not be considered valid because a setting in the configuration database has disabled the alarm. The public safety subsystem processing terminates at a block 730 if the alert is not considered valid. At a block 740, the alert may be prioritized and/or queued for distribution. The distribution or queuing priority may be controlled through settings in a configuration database. For example, a setting in the configuration database may place a higher priority for a response on an alert that signals a heart attack over an alert that signals a burglary. At a block 750, an alert may be prioritized and scheduled. One of skill in the art should realize that many possibilities for prioritizing and scheduling exist. For example, it may be that the alerts are given equal priority and are scheduled simultaneously.

At a block 760, an alert is distributed based on alert type, urgency and location. An alert may include distance and proximity information, such as latitude and longitude. It may also include time records and/or reports. The alert may specifically categorize the type of event. For example, the alert may specify that the event includes a fire or some other incendiary event and state the time of occurrence and location. The format of an alert may be a text message, an electronic mail, a fax transmittal, a telephonic communication, a page, or other communication means that would be recognized by one of skill in the art.

Figure 8:
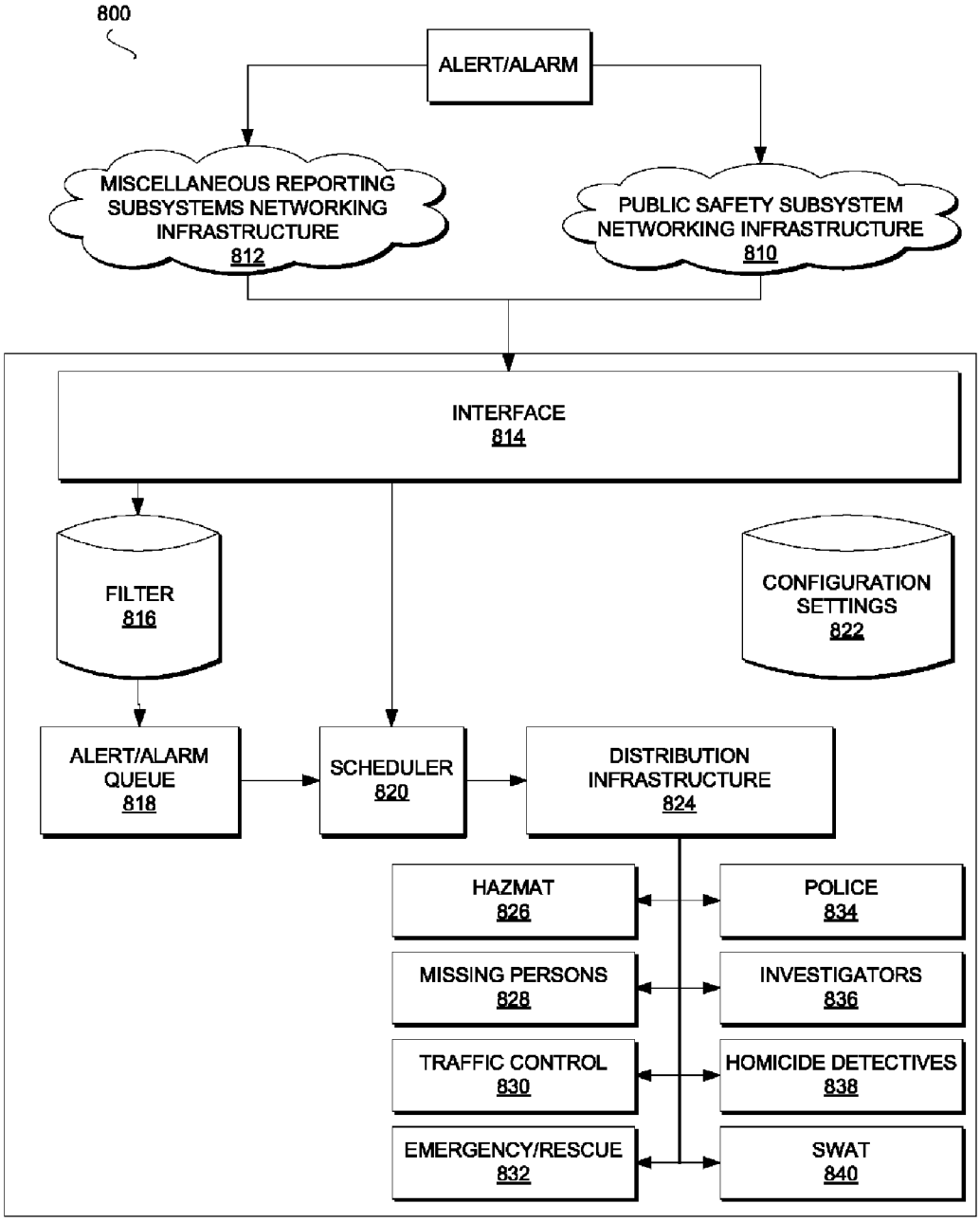
FIG. 8 is an implementation model detailing the public safety system according to one embodiment of the current disclosure.

FIG. 8 features an implementation model 800 of the public safety subsystem according to one embodiment. The public safety subsystem may include an interface 814 that interfaces to a plurality of reporting subsystems. One such reporting subsystem may be specific to the SensAlert networking infrastructure 810. Other miscellaneous reporting subsystems 812 may also be used. Alerts or alarms received through the public safety interface 814 may be processed through a filter 816 to determine their validity based on setting in a configuration database 822. The alert may be queued in an alert queue 818 for further processing. The configuration database 822 may also determine the queue and scheduling of the alert. A scheduler 820 may schedule the alert for distribution to distribution infrastructure 824. Distribution infrastructure may comprise multiple agencies or organizations, including but not limited, to a hazardous material (HAZMAT) 826 agency, missing persons bureau 828, traffic control 830, emergency 832, police 834, investigators 836, homicide detectives, 838, and a Special Weapons and Tactics (SWAT) agency 840. One or more agencies or organizations may be configured to receive an alert and, depending on the type of alert received, respond by deploying appropriate emergency or other resources from the agency or organization receiving the alert.

The flowchart and block diagrams in the Figures illustrate the architecture, functionality, and operation of possible implementations of systems, methods and computer program products according to various embodiments of the present invention. In this regard, each block in the flowchart or block diagrams may represent a module, segment, or portion of code, which comprises one or more executable instructions for implementing the specified logical function(s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

The invention can take the form of an entirely hardware embodiment, an entirely software embodiment or an embodiment containing both hardware and software elements. In a preferred embodiment, the invention is implemented in software, which includes but is not limited to firmware, resident software, microcode, etc.

Furthermore, the invention can take the form of a computer program product accessible from a computer-usable or computer-readable medium providing program code for use by or in connection with a computer or any instruction execution system. For the purposes of this description, a computer-usable or computer readable medium can be any tangible apparatus that can contain, store, communicate, propagate, or transport the program for use by or in connection with the instruction execution system, apparatus, or device.

The medium can be an electronic, magnetic, optical, electromagnetic, infrared, or semiconductor system (or apparatus or device) or a propagation medium. Examples of a computer-readable medium include a semiconductor or solid state memory, magnetic tape, a removable computer diskette, a random access memory (RAM), a read-only memory (ROM), a rigid magnetic disk and an optical disk. Current examples of optical disks include compact disk-read only memory (CD-ROM), compact disk-read/write (CD-R/W) and DVD.

A data processing system suitable for storing and/or executing program code will include at least one processor coupled directly or indirectly to memory elements through a system bus. The memory elements can include local memory employed during actual execution of the program code, bulk storage, and cache memories which provide temporary storage of at least some program code in order to reduce the number of times code must be retrieved from bulk storage during execution.

Input/output or I/O devices (including but not limited to keyboards, displays, pointing devices, etc.) can be coupled to the system either directly or through intervening I/O controllers.

Network adapters may also be coupled to the system to enable the data processing system to become coupled to other data processing systems or remote printers or storage devices through intervening private or public networks. Modems, cable modem and Ethernet cards are just a few of the currently available types of network adapters.

The description of the present invention has been presented for purposes of illustration and description, and is not intended to be exhaustive or limited to the invention in the form disclosed. Many modifications and variations will be apparent to those of ordinary skill in the art. The embodiment was chosen and described in order to best explain the principles of the invention, the practical application, and to enable others of ordinary skill in the art to understand the invention for various embodiments with various modifications as are suited to the particular use contemplated.

The scope of patented subject matter is defined only by the claims. The claims, as filed, are intended to be as comprehensive as possible, and no subject matter is intentionally relinquished, dedicated, or abandoned.

What is claimed is:

1. A computer-implemented method of reporting a critical event, the method comprising:

receiving input data, the input data comprising a digitized stream of signature data;

repeatedly analyzing the input data to determine an event context;

assessing a criticality of the determined event context; and responsive to the assessment of criticality, determining a reporting response.

2. The method of claim 1, wherein the digitized stream of signature data is selected from the group consisting of biometric information and g-force information.

3. The method of claim 1, wherein the input data comprises data received from a digital life recorder.

4. The method of claim 1, wherein the digitized stream of data is selected from the group consisting of video information and sound information.

5. The method of claim 1, wherein the repeatedly analyzing comprises:

iteratively comparing the input data to signature data stored in a glossary;

determining whether a match exists between the input data and the signature data; and responsive to a match existing between the detected sensor data and the signature data, categorizing the input data as an event.

6. The method of claim 1, wherein the assessing a criticality comprises determining whether the event data meets a threshold setting, the threshold setting being part of a configuration data.

7. The method of claim 6, wherein responsive to the event data meeting a threshold setting, filtering the event data based on a configuration setting.

8. The method of claim 7, wherein the filtering comprises inhibiting the reporting response.

9. The method of claim 1, wherein determining the reporting response comprises configuring an alert based on the determined event context.

10. The method of claim 1, wherein the reporting response comprises an alert.

11. The method of claim 10, wherein the alert comprises one of an auditory alarm and a text message.

12. A system comprising a plurality of integrated subsystems configurable for processing sensory data, the system comprising:

an analysis subsystem that determines an event context based on a glossary comprising signature data; and a reporting subsystem, communicatively coupled to the analysis subsystem, that receives the event context determined by the analysis subsystem.

13. The system of claim 12, further comprising a public safety subsystem interfaced to the analysis subsystem and the reporting subsystem, the public safety subsystem enabled to receive reported events and broadcast an alert.

14. The system of claim 13, wherein the public safety subsystem receives reported events from a plurality of reporting subsystems.

15. The system of claim 12, wherein the analysis subsystem further comprises a glossary, the glossary comprising a digitized stream of signature data.

16. The system of claim 12, wherein the reporting subsystem configures an alarm based on the event context and broadcasts the alarm notice.

17. The system of claim 12, wherein the glossary comprises a signature data selected from one of sounds, faces, and sensor events.

18. A system for broadcasting a critical alert, the system comprising:

an external interface;

a receiving mechanism that logs a receipt of a reported event;

a prioritizing mechanism that grades the urgency of the received reported event based on a configuration setting;

responsive to grading of the urgency of the received reported event, a distributing mechanism that broadcasts an alert.

19. The system of claim 18, further comprising a filtering mechanism that determines a validity of a received reported event.

20. The system of claim 19, wherein the external interface networks to a plurality of reporting subsystems.

* * * * *